US005413072A

United States Patent [19]

Andersen et al.

[11] Patent Number: 5,413,072

[45] Date of Patent: May 9, 1995

[54] VEHICLE STARTER AND ELECTRICAL SYSTEM PROTECTION

[75] Inventors: Christian J. Andersen, Cadillac; Duane W. Gebauer; Ronald D. Ingraham, both of Reed City, all of Mich.

[73] Assignee: Nartron Corporation, Reed City, Mich.

[21] Appl. No.: 165,968

[22] Filed: Dec. 10, 1993

Related U.S. Application Data

[62] Division of Ser. No. 745,511, Aug. 15, 1991, Pat. No. 5,287,831.

[51] Int. Cl.[6] ..... F02P 19/02

[52] U.S. Cl. ..... 123/145 A; 123/179.6; 219/501; 219/506; 361/265

[58] Field of Search ..... 123/179.6, 179.21, 145 A; 219/501, 506; 361/265, 264; 340/640

[56] References Cited

U.S. PATENT DOCUMENTS

| | | | |
|---|---|---|---|
| 4,209,816 | 6/1980 | Hansen | 123/179.3 |
| 4,307,689 | 12/1981 | Raeske et al. | 123/179.21 |
| 4,607,153 | 8/1986 | Ang et al. | 123/179.21 |
| 4,622,930 | 11/1986 | Hamano et al. | 123/179.3 |
| 4,731,543 | 3/1988 | Buetemeister et al. | 290/38 R |
| 4,901,690 | 2/1990 | Cummins et al. | 123/179.3 |

FOREIGN PATENT DOCUMENTS

| | | | |
|---|---|---|---|
| 2757818 | 6/1979 | Germany | 290/37 A |

*Primary Examiner*—Andrew M. Dolinar

*Attorney, Agent, or Firm*—Watts, Hoffmann, Fisher & Heinke Co.

[57] ABSTRACT

A protective control box is disclosure for providing protection for a starter system and other components of equipment, such as vehicles, incorporating internal combustion engines. Improved starter protection apparatus and circuitry using frequency to voltage conversion disables a starter motor from starting the internal combustion engine when engine speed exceeds a pre-determined level. The starter cannot be re-actuated until and unless engine speed has fallen below a second lower pre-determined speed level. The protection box includes a lockout solenoid which in turn selectively locks out the main starter solenoid in accordance with the foregoing conditions. A wait-to-start lamp and associated comparator and latching circuitry is provided for actuating the wait lamp in response to initiation of glow plug controller pre-glow operation, and for subsequently extinguishing the lamp. Once extinguished, the lamp cannot be re-actuated until and unless the ignition has been toggled. Circuitry including a field effect transistor is provided for controlling glow plug controller operation by means of an auxiliary solenoid. Load dump control circuitry responsive to frequency to voltage conversion inhibits disconnection of electrical loads from a motor-driven alternator even when the ignition is turned off, until engine speed has dropped to a safe level. This prevents voltage spikes which would otherwise result from the sudden unloading of the alternator, a phenomenon which could damage a voltage regulator or other electrical circuitry. After-glow control maintains glow plug controller operation until ambient engine temperature has reached a pre-determined level.

8 Claims, 5 Drawing Sheets

VEHICLE STARTER AND ELECTRICAL SYSTEM PROTECTION

This is a divisional of application Ser. No. 07/745,511, filed Aug. 15,1991, now U.S. Pat. No. 5,287,831.

FIELD OF THE INVENTION

This invention relates generally to the field of vehicle electrical systems, and more particularly to improved circuitry for providing protection for various components of the starting and electrical systems of a motor vehicle.

BACKGROUND ART

The present invention is intended for use in an environment of a self-propelled vehicle or other piece of equipment which is powered by a known form of internal combustion engine. The invention is preferably designed for use in connection with a vehicle or other equipment powered by a diesel engine.

Diesel engines do not use spark plugs. Rather, they rely for ignition of the fuel-air mixture on compression of that mixture by rapid motion of a piston to reduce the volume of a fuel-air charge in the combustion chamber.

When a diesel engine starts up, however, known glow plugs are used to initiate engine starting ignition. The glow plugs typically are operated for a brief time, until the started engine comes up to speed, at which time the glow plugs are either gradually or abruptly turned off.

Vehicles of the type forming the environment for the present invention are commonly heavy-duty military vehicles such as trucks, infantry fighting vehicles, tanks, and others. Because such vehicles are typically operated by a large number of operators having different skill levels, considerable warning and protection equipment is incorporated into such vehicles. This warning and protection equipment includes means for informing an operator of the operations and conditions of certain vehicle and engine components.

The glow plugs of diesel engines are commonly controlled by a glow plug controller circuit. The glow plug controller circuit, upon an operator turning on the ignition, applies a high DC current, often in the neighborhood of 150 amps, to the glow plugs continuously during what is known as a "pre-glow" mode. A sensor detects the static temperature of the engine and controls the pre-glow mode which endures for a period of time, typically 3–8 seconds. Following the pre-glow portion of the cycle, the glow plug controller shifts to an "afterglow" portion of the cycle. During the afterglow portion, the glow plugs are continued in pulsed operation, until the sensor detects that the ambient engine temperature has risen to a predetermined level, after which the glow plugs are turned off. Sometimes, during the afterglow cycle, the duty cycle of the glow plugs is adjusted, the duty cycle being reduced as the ambient engine temperature rises prior to glow plug cut-off.

Heavy-duty vehicles of this nature include switching mechanism for selectively disconnecting all or a part of the electrical loads from a battery which is used to provide electrical power for the vehicle. This function is sometimes called "load dumping." Generally, the load dumping is controlled by electronics which senses engine shut-off and commands a solenoid to drop out the vehicle loads after the conditions of ignition switch off and engine speed is below 100 RPM's are coincidentally met. The reason for doing this is to keep the battery connected as long as possible to keep the vehicle systems' electrical transients from disrupting the vehicle's other electrical components such as a solid state glow plug controller.

Some diesel powered vehicles have a "wait" lamp which comes on during the pre-glow portion of the cycle, to indicate to the operator that the glow plugs are operating, but that they have not yet reached a sufficient temperature to enable easy starting. When the pre-glow portion of the cycle is completed, the wait lamp turns off, informing the operator that the vehicle is ready for starting.

FIG. 1 is a partially schematic, partially block diagram illustrating some of the components of a diesel engine and associated peripheral equipment which form the environment for the present invention. The items illustrated in FIG. 1 do not form part of the present invention per se, but rather are known components in connection with which the present invention, described in detail in succeeding sections, operates. The components illustrated in FIG. 1 are all known and within the skill of one ordinarily conversant with the relevant art. FIG. 1, and this description, is provided for the benefit of those not intimately familiar with this art. FIG. 1 is not intended as a detailed schematic description of these known components. Rather, FIG. 1 is intended only for a general understanding of the relationship among these components.

Toward the left-hand portion of FIG. 1 is a column of eight glow plugs, the uppermost of which is indicated by the reference character G. Operation of the glow plugs is governed by a glow plug controller indicated as GPC. An electric starter motor M, with associated switching, is provided for starting the engine. Batteries B are provided for selectively actuating the starter motor M, and for providing DC electrical power for operating other electrical components of the vehicle and for peripheral components of the engine as needed. The vehicle batteries provide 24 volts DC. The vehicle operates, while running, at 28 volts. Preferably, two batteries in series are provided.

A run/start switch RS is provided for actuating the vehicle ignition circuitry and for selectively actuating the starter.

An alternator A, driven by the engine, provides electrical power for charging the batteries B for providing electrical power to the vehicles loads. The alternator A has an "R tap," (connected to the field) indicated by reference character R.

A fuel Solenoid F governs flow of fuel to the engine.

A clutch control C electrically engages and disengages an electric motor driven engine cooling fan.

A wait-to-start lamp W provides a visual indication to an operator when the pre-glow cycle is occurring and it would thus be inappropriate to try to start the diesel engine. A brake warning lamp BW indicates to the operator when a parking brake is set. The brake warning lamp BW also indicates when the start solenoid is engaged. A brake pressure switch BP provides an indication to the operator when a pre-determined amount of force is applied to the service brake pedal. A park brake switch PB, indicates by means of the lamp that the vehicle parking brake is set.

The electrical system of the engine operates several types of electrical loads. One such load is a heater motor indicated generally at the reference character H. Lighting loads are connected to a lead generally indicated by the reference character LL. Certain miscellaneous electrical vehicle loads are indicated by the resistor at reference character VL.

The present invention, as will be described in detail, includes improved circuitry and sub-circuits for governing and safe-guarding operation of the known components illustrated in FIG. 1. Interfaces for connecting the known components of FIG. 1 are provided by an engine connector C1 and a body connector C2, both illustrated in FIG. 1. These connectors interface between the inventive circuitry (not shown in FIG. 1) and the engine and vehicle components shown in FIG. 1.

The concept of controlling glow plugs with solid state controller devices including clocking circuits regulating such functions as glow plug preheat and afterglow control, as well as control of the duty cycle of glow plugs, and temperature related control, is well known. For example, Arnold et al., U.S. Pat. No. 4,882,370, shows a solid state microprocessor controlled device for regulating many aspects of glow plug performance. The Arnold circuitry adjusts the duty cycle of glow plugs as a function of temperature, regulates preglow function, and detects undesirable short circuits and open circuits for implementing a disable function. U.S. Pat. No. 4,300,491, to Hara et al., achieves a variable time control of the pre-glow period by means of a plurality of transistors and diodes. Van Ostrom, U.S. Pat. No. 4,137,885 describes means for cyclicly interrupting a glow plug energizing circuit when a maximum temperature is reached. Cooper, U.S. Pat. No. 4,312,307 describes circuitry for control of the duty cycle of glow plugs by means of heat-sensitive switches. Each of the above-identified United States patents listed in this paragraph are hereby expressly incorporated by reference.

It is a general object of the present invention to provide improved circuitry and apparatus to control and protect the vehicular starter and electrical system.

DESCRIPTION OF THE INVENTION

The disadvantages of the prior art are reduced or eliminated by a protective control box whose primary function is to prevent damage to the vehicle starter during engine start. The protective control box also controls power to most of the vehicle loads during start of the vehicle.

The protective control box utilizes improved comparator and latching circuitry to switch on a wait-to-start lamp during the pre-glow cycle of the engine glow plugs to indicate to the vehicle operator that the engine glow plugs are in operation. The wait-to-start lamp is only energized in response to the ignition (run) switch RS changing from its off to its run mode and the glow plug controller signaling the protective control box for a pre-glow cycle to occur. No other sequence will actuate the wait-to-start lamp.

The protective control box switches on the brake warning lamp when a starter solenoid is engaged. When either the parking brake switch or the brake pressure switch are closed and ignition switch is in "run" the brake warning lamp will be in its on mode.

The on/off state of the starter motor is determined by the frequency of an AC signal produced by the engine alternator, and detected by improved frequency to voltage logic, and by the condition of a starter switch. When the frequency of the alternator R-tap is above 65 Hz and the starter solenoid is not energized, or the frequency of the alternator R-tap is between 125 Hz and 145 Hz and the start solenoid is engaged, the starter is disabled. The starter will remain disabled until the alternator R-tap frequency drops to 10 Hz or below. A solenoid within the protective control box is provided to engage and disengage the starter solenoid on the engine starter motor.

This feature prevents a vehicle operator from actuating the starter, and exposing engine components to potential damage, by trying to activate the starter of a running engine, or by holding the starter on after the engine has already started.

Battery voltage is applied to various vehicle loads through the protective control box via a load dumping solenoid, The protective control box provides protection against reverse polarity and provides protection against high-speed load dumping by use of frequency to voltage circuitry. Protection against disconnection of electrical load from the alternator in response to the run switch being turned to its off mode prevents the occurrence of load-induced damaging voltage spikes which can be harmful to the alternator regulator if the normally heavily inductive loads are dumped at high engine speed.

A glow plug solenoid within the protective control box is employed to control the high power directed to the engine block glow plugs. The on/off condition of the glow plugs is controlled by the protective control box, but the duty cycle of the glow plugs is determined by the glow plug controller which is external to the protective control box.

The glow plug control solenoid is itself controlled by a field effect transistor. Voltage is regulated by a matched pair of other transistors.

These and other aspects of the present invention will be understood in more detail by reference to the following detailed description and to the drawings, in which:

BEST MODE FOR CARRYING OUT THE INVENTION

Figure 1:
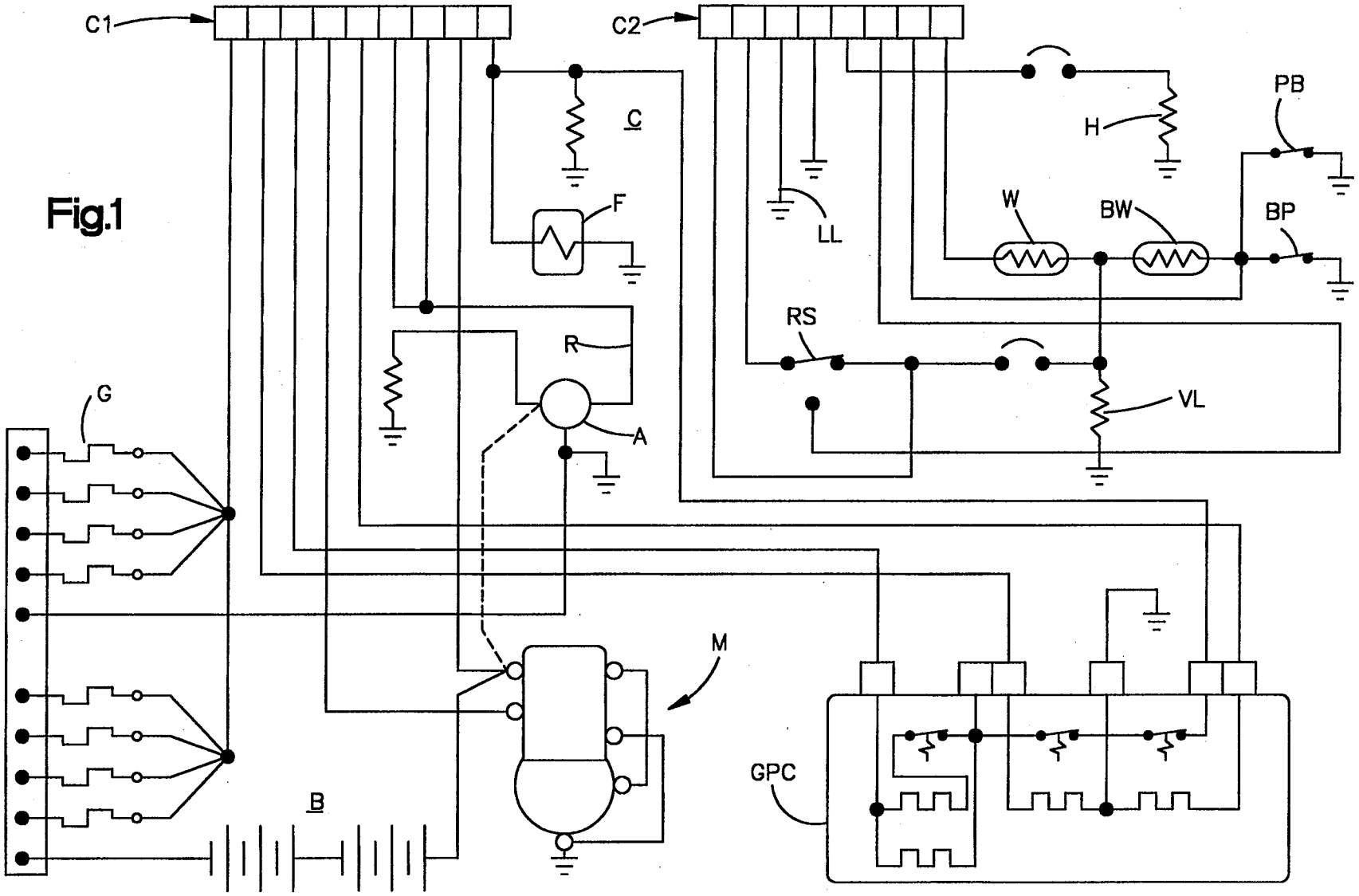
FIG. 1 is a partially schematic, partially block diagram illustrating a portion of the environment in which the present invention is incorporated.

This invention involves a protective control box for equipment such as a vehicle, for example, a military vehicle or transporter driven by a diesel engine employing glow plugs and having an alternator, a battery, a starter, ignition control switching, and other components generally considered desirable or necessary for operating a diesel engine for driving a self-propelled piece of equipment. Such components are described above in connection with FIG. 1.

The protective control box of the present invention includes a metal housing which encloses various types of sub-circuits for protecting various aspects of operation of the engine and its associated components.

While the protective control box can be mounted at any suitable location on the vehicle, tests have indicated that it is preferable to mount the protective control box on the inside fire wall of the passenger compartment of the vehicle.

The protective control box protects components such as the starter, the glow plug actuation controllers and the alternator. It also provides certain safety-oriented indications to a vehicle operator. The following is a brief description of the basic features of the protective control box.

The protective control box is used to, among other things, safeguard the starter system of the vehicle. The vehicle operator presses a console "run" (including ignition) switch to activate the protective control box by providing electrical power to its various circuits and components.

If the ambient engine temperature warrants, the protective control box receives an input signal from the engine's glow plug controller and turns the power to the glow plugs on and off as a function of that input signal. The glow plug controller calls for the power; the protective control box answers that call with facility.

When a vehicle operator toggles the ignition switch from run to start for the engine, the protective control box gates the supply of power to the starter solenoid and thus provides control for the activation of the starter. In conjunction with this function, the protective control box causes a brake lamp to turn on at the time the starter is actuated in order to indicate to the vehicle operator that a starting condition has occurred.

If, however, conditions are such that it would be dangerous or potentially damaging to the engine or its components to attempt to start the engine, i.e., a lockout condition is detected by the protective control box, the protective control box will prevent the application of power to the starter system irrespective of the vehicle operator's actions. Thus, under certain conditions, the protective control box will prevent application of power to the starter by locking out the actuation of the starter solenoid. This feature protects the starter from damage.

The two starter lockout conditions detected by the protective control box are: (1) trying to activate the starter of a running vehicle, and (2) holding the starter on after the vehicle has already started.

The protective control box also protects the alternator and other circuitry of the vehicle by keeping the electrical load connected to the battery output even after the vehicle operator turns off the run (ignition) switch, until the engine has slowed sufficiently. This feature of delaying disconnection of the load from the battery prevents a large and potentially damage-induced voltage spike to the voltage regulator as would result if the largely inductive load were disconnected while the engine and alternator were still delivering high current.

Figure 1A:
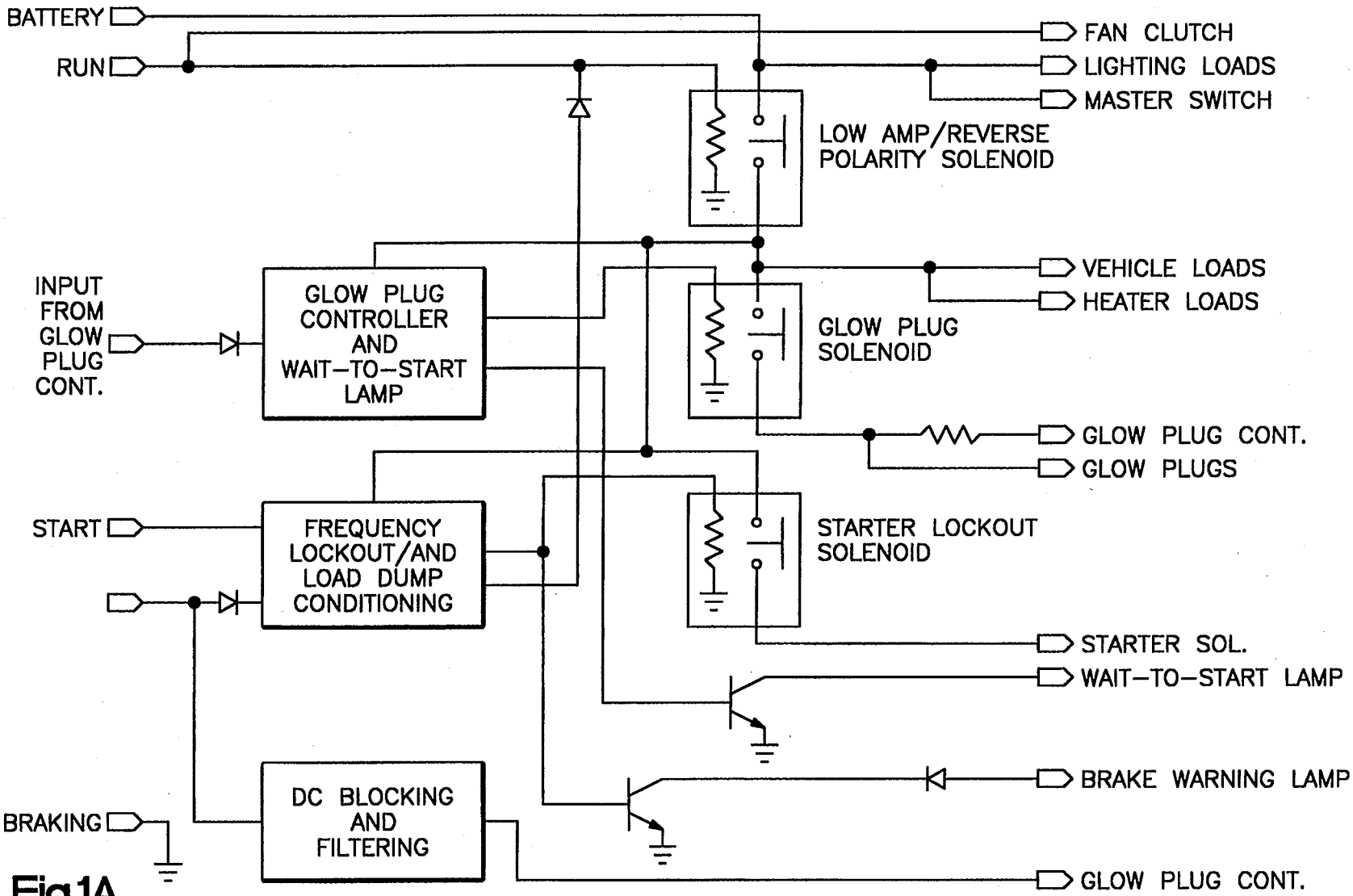
FIG. 1A is a blocked diagram illustrating the circuitry of the present invention.
Figure 2:
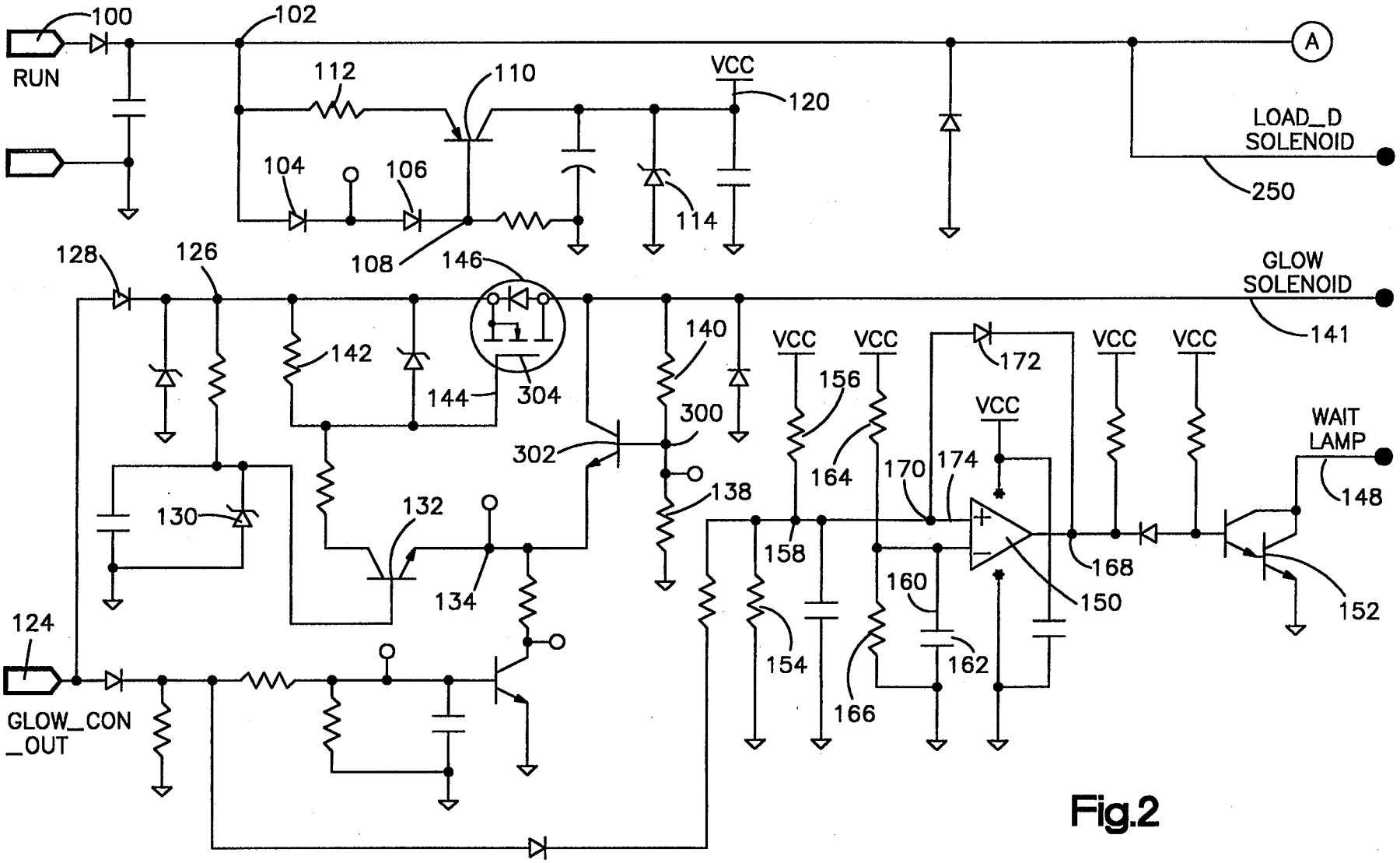
FIGS. 2, 3A and 3B are schematic diagrams illustrating the circuitry of the present invention which is utilized in conjunction with the environment illustrated in FIG. 1.
Figure 3A:
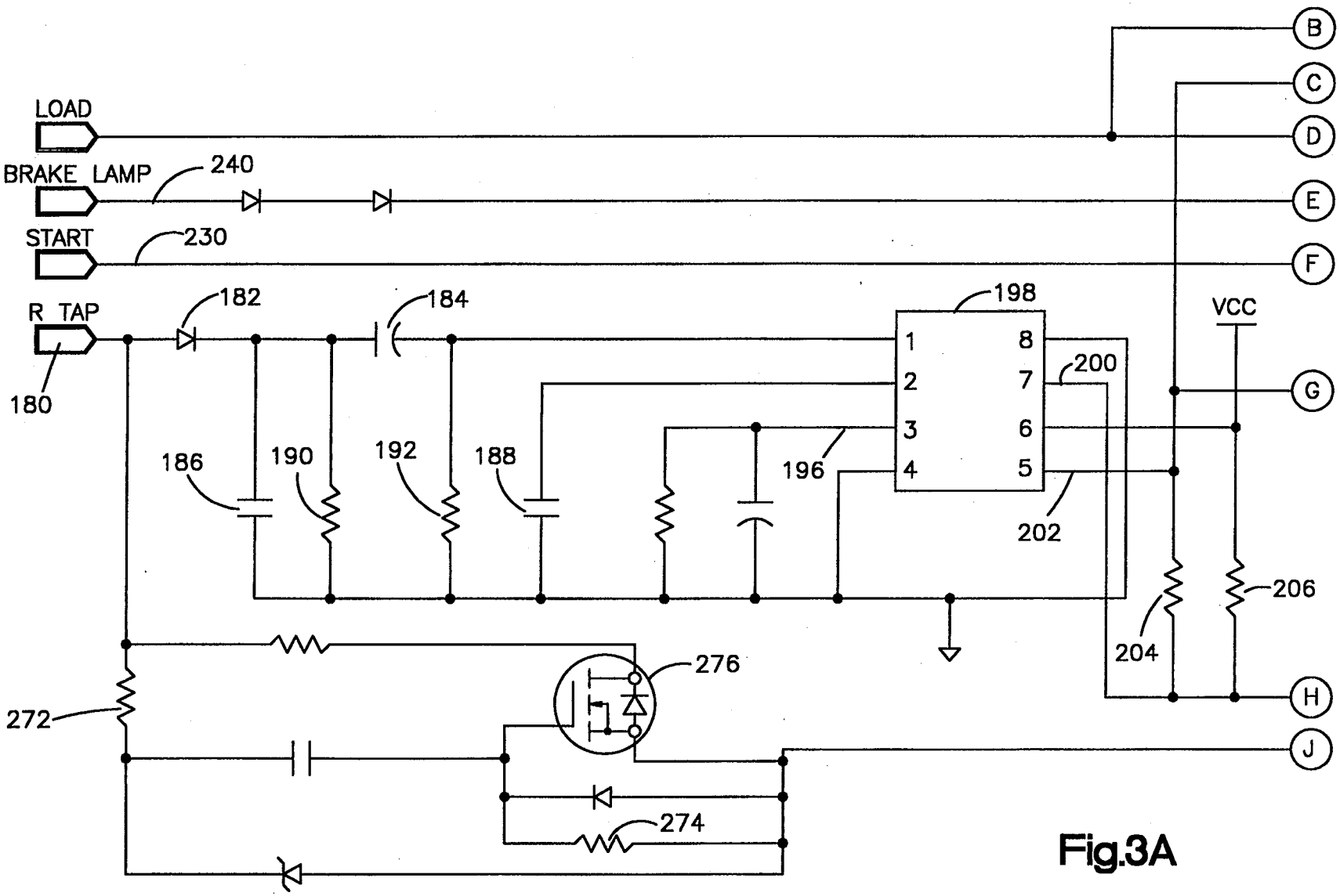
Figure 3B:
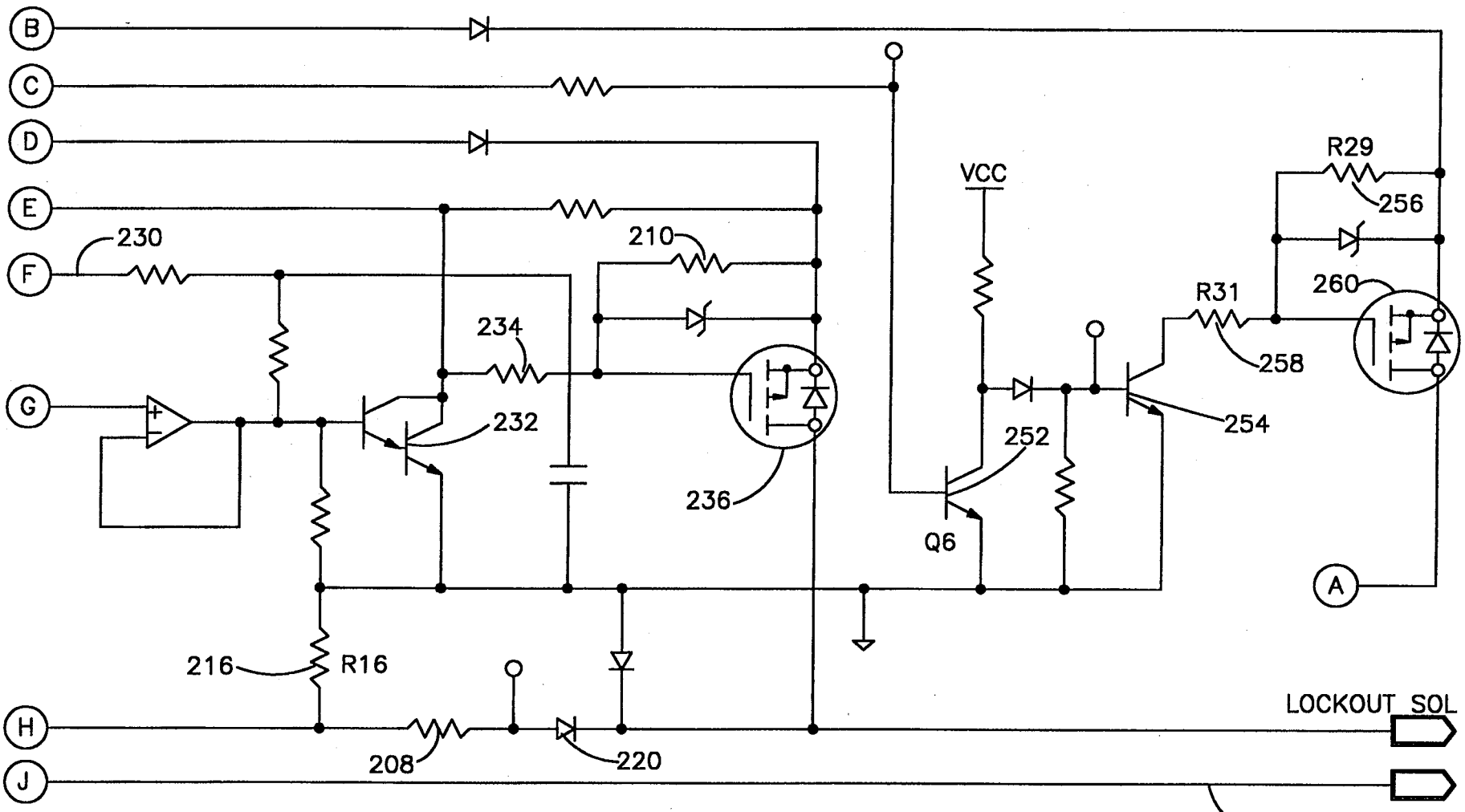

The present protective control box includes seven operational sub-circuits (see FIG. 1*a*):

1. Power Supply
2. Glow-Plug Solenoid Power Supply
3. Wait-Lamp Drive
4. Frequency to Voltage Control Logic
5. Lockout Solenoid Control
6. Load Dump Solenoid Control
7. After-Glow Supply The electrical operation of each of these sub-circuits will now be described in detail, with particular reference to FIGS. 2, 3A and 3B. The letter reference characters in FIGS. 2, 3*a* and 3*b* are indicators of lead line connections bridging these figures. They do not correspond to the reference characters of FIG. 1.

POWER SUPPLY SUB-CIRCUIT

Referring to FIG. 2, a run (ignition) input switch 100 is provided. Closure of the run input switch 100 applies 28 volts DC to a node 102. Two diodes 104, 106 drop the voltage at a node 108 to 26.6 volts. This voltage enables a transistor 110 to turn on. The transistor 110 will remain in its on condition as long as the voltage drop across a resistor 112 is less than 0.7 volts. This relationship between the transistor 110 and the resistor 112 limits the power supply current to approximately 30 mA. A zener diode 114 at a node 116 is a 7.5-volt, 1-watt device used to maintain a Vcc of 7.5 volts. The voltage Vcc appears at a lead 120 Vcc is applied at all points in the schematic diagrams of FIGS. 2, 3A and 3B labeled "Vcc".

GLOW PLUG SOLENOID POWER SUPPLY CONTROL SUB-CIRCUIT

An input 124 is provided. The input 124 carries a signal from the glow plug controller (not shown in FIG. 2, shown as GPC in FIG. 1). The signal carried at the input 124 is a time-changing signal which indicates the timing sequence in which power should be applied to the glow plugs (not shown in FIG. 2, shown as G in FIG. 1). In the present embodiment, the signal appearing at the lead 124 is alternately on and off.

The signal at the input 124 is used to control supply to a glow plug solenoid (not shown) which is part of the known protective control box. The glow plug solenoid internal resistance is about 8 ohms. Sufficient power is required at the input 124 to supply 1.5 amps at 12 volts to the glow plug solenoid.

A signal at a node 126 is the same as the signal at input 124 minus the voltage drop across a diode 128. The signal at a node 126, when high enables a zener diode 130. The diode 130 is a 5.1-volt, 1-watt device which is positioned to turn on a transistor 132. The voltage across the diode 130 is 5.1 volts when the node 126 is high. The voltage at a node 134 is 4.4 volts, and is equal to the voltage across the zener diode 130 (5.1 volts) minus the voltage drop (0.7 volts) across the emitter-base junction of the transistor 132.

A voltage divider including resistors 138, 140. The voltage drop produced across a resistor 142, when the transistor 132 is in its on condition, provides the power, at a lead 144, to turn on a P-channel enhancement-mode power field-effect transistor 146. The transistor 146 has the capacity to easily accommodate the 1.5 amp current needed by the glow plug solenoid. The transistor 132 and a second transistor 302 constitute a matching pair of transistors which, when turned on, operate to provide a regulated voltage signal at a gate 304 of the field-effect transistor 146 for gating the field-effect transistor.

WAIT-LAMP DRIVE SUB-CIRCUIT

The wait-lamp drive sub-circuit turns on a wait lamp (not shown in FIG. 2, but shown as W in FIG. 1), by sinking current at a lead 148, during the first on (pre-glow) period of the signal applied to the glow plug solenoid at the lead 141.

Initially, with the run switch 100 in its off state, the output of a comparator 150 and a Darlington and transistor 152 are in their off states. In this condition, the collector of the transistor 152 is off, which disables the wait lamp.

If the run switch 100 is then closed, enabling the 7.5 volt Vcc power supply, and the glow plug controller signal at the input 124 is not activated, the voltage produced by a voltage divider including resistors 154, 156 at a node 158 is 1.45 volts.

The voltage appearing at the input 160 of the comparator 150 is initially zero volts because a capacitor 162 appears initially as a short circuit and charges at a rate determined by the RC time constant dictated by the combination of the resistors 164, 166 and the capacitor 162 delay. The voltage at a node 168 is equal to the voltage at a node 170 (1.45 volts which of course is also the voltage at the node 158) minus the voltage drop across a diode 168 (0.7 volts). The voltage at the node 172 (0.75 volts) is not sufficient to turn on the transistor 152. Therefore, the wait lamp remains off until the capacitor 162 charges. When the capacitor 162 is charged to a value greater than that seen at an input 174 of the comparator 150, the output of the comparator 150 goes low and is latched low by the diode 172. The comparator output will thus remain low, being unable to turn on the wait lamp unless the power is cycled.

If, however, the run switch 100 and the glow plug controller signal at the input 124 are both activated, the voltage produced by the voltage divider including the resistors 156, 158 at the node 158 is between 3 and 6 volts, depending upon the glow plug controller signal level at the input 124 (16–33 volts). With both the run switch 100 on and the glow plug controller signal appearing at the input 124 being high, the voltage at the input 160 of the comparator 150 is about 2.5 volts. Under this condition, the voltage at the output of the comparator 150 goes high enough to turn on the transistor 152, which turns on the wait lamp. When the glow plug controller signal at the input 124 goes low after the first, or pre-glow, cycle of the glow plugs, the voltage at the comparator input 174 changes state, that is, the voltage is reduced. Therefore, the output of the comparator 150 also goes low, turning off the wait lamp. When the output of the comparator 150 goes low, it is latched low again by the diode 172 and is held low regardless of the glow plug controller signal at the lead 124 and will remain latched low until the main power is cycled, or toggled, off and then back on again.

FREQUENCY TO VOLTAGE CONTROL LOGIC SUB-CIRCUIT

Referring now to FIGS. 3A and 3B, the input 180 is the alternating R-tap from the field of the alternator of the vehicle. Its frequency depends on engine speed. This signal is filtered and rectified by diode 182, capacitors 184, 186 and by resistors 190, 192. This filtering and rectification makes the signal appearing at the lead 180 compatible with the input constraints of frequency to voltage convertor circuitry to be described momentarily. The frequency to voltage convertor is an LM 2907N-8 integrated circuit chip made by National Semiconductor. Alternately, the voltage convertor can be an integrated circuit chip number LM 2907P manufactured by Texas Instruments, Dallas, Tex., U.S.A., or a chip number CS-2907N8 manufactured by Cherry Products. The signal at the input 180 varies between zero to greater than 150 Hz., depending upon the alternator speed, which in turn is dependent upon the vehicle engine speed. When the voltage at an input 196 (pin 3) of the frequency to voltage convertor 198 is greater than a reference voltage appearing at an input 200 (pin 7), the output of the convertor 202 (pin 5) is pulled low (via an internal comparator not shown). The output of the convertor 198 is designated by reference character 202. The voltage at the input 196 is determined by the following equation:

$$V_{out} = \text{Freq.}_{in} \times Vcc \times R_1 \times C_1$$

The values of $R_1$ and $C_1$ are 540,000 ohms and 10 nanofarads, respectively.

Since Vcc, $R_1$ and $C_1$ are constant, $V_{out}$ varies only when the frequency Freq.$_{in}$ changes. Initially, the voltage at the lead 202 is the same as that at the lead 200 and the reference voltage is set by the voltage divider which is constituted by the resistors 206, 208 and diode 220. To obtain a frequency Freq.$_{in}$ from the R-tap of the alternator, the engine starter must have been initially engaged. Therefore, while a lockout solenoid (not shown) is engaged, the frequency from the alternator R-tap increases. When the frequency rises to a level of greater than 65 Hz. the voltage at the input 196 increases to a level greater than that set by the reference voltage at the input 200, the output 202 is pulled to ground allowing the solenoid lockout sub-circuit to lock out the starter solenoid, thus preventing the vehicle operator from damaging the starter by turning the start switch on while the vehicle is running. When the lockout solenoid is activated, a new reference voltage is established with a voltage divider then constituted by the resistors 206 and R16 (216).

This new reference voltage when voltage divider which is constituted by the resistors 206 and 216 is much lower than the previous reference voltage which means that the frequency input can be much smaller (9 Hz.) and still provide a voltage output high enough to keep the output at the lead 202 low. This in turn means that, once the vehicle engine is running, the starter cannot be re-engaged until the R-tap frequency from the vehicle engine alternator falls below 9 Hz.

In another set of circumstances, when the lockout solenoid is activated and the start switch remains engaged, still another reference voltage, determined by the voltage dividing effect of resistors 206, 216 (R16) is established at the input 200 of the convertor 198. This reference voltage is established such that the R-tap frequency appearing at the input 124 must be at least 125 Hz. to raise the output voltage to the level necessary to pull the signal at the lead 202 to ground and to thus de-activate the lockout solenoid. This feature prevents the starter from being damaged when the start switch is held in the activated position too long, i.e., until a time after which the engine has already commenced running.

LOCKOUT SOLENOID CONTROL SUB-CIRCUIT

The purpose of the lockout solenoid is to disable the vehicle starter when circumstances exist which could cause damage to the starter should the starter be actuated, or when damage to the starter while operating appears imminent. The starter damage conditions addressed by the lockout solenoid control sub-circuit are (1) holding the starter in its actuated state for an excessively long time and (2) actuating the starter while the vehicle engine is running.

Referring to FIGS. 3A and 3B, a lead 230 carries a signal which is in a first, or higher state, when the starter is actuated, and which is in a lower and depressed condition when the starter is not actuated.

If the output 202 of the convertor 198 is floating, which corresponds to a non-lockout condition, a high signal at the starter input 230 will turn on a transistor 232. This in turn enables a voltage divider including resistors 210, 234 to turn on a transistor 236. This condition allows a 30-volt load solenoid on the source of the transistor 236 to drive the starter solenoid, which is external to the circuitry here described. In addition, when the starter input 230 is high, a brake lamp input 240 is pulsed to ground by way of the transistor 232. This function turns on the brake warning lamp while the starter is engaged.

If the output 202 of the converter 198 is pulsed to ground because of a solenoid lockout condition, the start signal at the lead 230 will not be able to turn on the transistor 232. The transistor 232 will then be unable to turn on the transistor 236. This, in turn, prevents the starter solenoid from being activated.

In turn, the starter solenoid will not be able to turn on the brake lamp by way of the transistor 232.

LOAD DUMP SOLENOID CONTROL SUB-CIRCUIT

The load dump solenoid control is designed to keep the load dump solenoid (see reference character 250 in FIG. 2) activated (load connected) even after the run switch 100 is turned off by the vehicle operator. The purpose of this feature is so that the vehicle alternator remains in a loaded condition even after the vehicle engine is turned off. This is beneficial because it prevents the imposition of a large damaging voltage spike upon the vehicle voltage regulator which would result when the alternator abruptly unloaded at high speed.

When the vehicle engine is running above a given speed, the output 202 of the convertor 198 is pulled to ground. This floats the collector of a transistor 252. This in turn turns on a transistor 254 and activates a voltage divider consisting of resistors 256 and 258. This provides the necessary voltage to turn on a field effect transistor 260 which enables a 30-volt load solenoid 250 which keeps the loads activated on the vehicle when the run switch 100 is turned to its off condition, until the engine speed slows to a second level lower than the predetermined level referred to above.

AFTER-GLOW SUPPLY SUB-CIRCUIT

The after-glow supply sub-circuit supplies an AC signal at a lead 270 appearing in FIG. 3B. The AC signal supplied is derived from the R-tap from the engine alternator which appears at the lead indicated by reference character 180 in FIG. 3A. The AC signal produced at the lead 270 is delivered to the glow plug controller of the engine which is external to the circuitry described and illustrated in connection with FIGS. 2, 3A and 3B. The AC signal at the lead 270 is used by the glow plug controller in known fashion to drive a temperature sensitive bi-metallic switch which is part of the glow plug controller. The bi-metallic switch or solid state controller input determines the duration of the glow plug afterglow cycle. The glow plugs cycle in afterglow as long as the bi-metallic switch remains closed or the solid state controller times out, whichever happens first.

The signal at the lead 180 goes through a voltage divider including resistors 272 and 274 and is AC coupled, as shown in FIG. 3A, to the gate of a transistor 276. This, as can be seen from an inspection of FIGS. 3A and 3B, provides an AC signal output at the lead 270. The AC signal preferably has an amplitude of approximately 16 to 33 volts at the input node 180.

MECHANICAL ASPECTS

The protective control box described herein is housed in a metal box with dimensions of approximately 27.94 centimeters×13.34 centimeters×9.07 centimeters.

The box is provided with ventilation apertures. The ventilation apertures are used to dissipate the considerable heat generated by the various solenoids described herein above. The protective control box is preferably submersible and therefore, it is recommended that all the internal components be conformally coated.

Preferably, metal can solenoids are employed in the protective control box. Tests have shown that metal can solenoids are superior to Bakelite solenoids in that the metal can solenoids can operate reliably at significantly higher temperatures that can Bakelite solenoids.

In view of the fact that it is desirable that the protective control box be easily serviceable, it is recommended that the circuitry as described herein be implemented in known fashion in form of one or more replaceable circuit boards.

While the specific preferred embodiment of the present invention has been discussed herein with some particularity, it is to be understood that those of ordinary skill in the relevant technical art may make certain additions or modifications to, or deletions from, the disclosure of this document without departing from the spirit of the scope of the invention, as defined in the appended claims.

We claim:

1. A glow plug actuation indicator for equipment having an internal combustion diesel engine including at least one glow plug, an engine ignition switch, toggleable between an on and an off position, and a glow plug controller circuit for energizing the glow plug in a pre-glow mode of operation for a period of time subsequent to the engine ignition switch being toggled to the on position, the controller circuit generating a signal at an output node when the glow plug is energized in the pre-glow mode of operation, said glow plug actuation indicator comprising:

a) a wait-to-start lamp actuated when the glow plug is energized in the pre-glow mode of operation;

b) a voltage regulator circuit coupled to the ignition switch generating a voltage signal at an output node when the ignition switch is in the on position; and c) lamp actuation circuitry coupled to the wait-to-start lamp, the controller circuit output node and the voltage regulator circuit output node for actuating said lamp in response to a signal at the controller circuit output node indicative of pre-glow operation of said glow plug and the ignition switch is in the on position, the lamp actuation circuitry including:

i) a switch coupled to the lamp for actuating said lamp;

ii) a timing circuit;

iii) a comparator having first and second input terminals and an output terminal for activating the switch, the output terminal being connected to the switch and further being coupled to the voltage regulator circuit output node, one of the first and second input terminals connected to the timing circuit and the other of the first and second input terminals coupled to the controller circuit output node, the comparator generating a high output signal when a signal magnitude at the input terminal coupled to the controller circuit output node exceeds a signal magnitude at the input terminal connected to the timing circuit;

iv) the switch being turned on when both the ignition switch is in the on position and the comparator output signal is high.

2. The glow plug actuation indicator of claim 1 wherein the timing circuit comprises a capacitor charging circuit.

3. The glow plug actuation indicator of claim 2 wherein the capacitor charging circuit is coupled to the voltage regulator circuit output node and is energized thereby.

4. The glow plug actuation indicator of claim 1 wherein the switch comprises a switching transistor and the comparator output terminal is connected to a base terminal of the switching transistor.

5. The glow plug actuation indicator of claim 4 wherein a collector terminal of the switching transistor is coupled to the wait-to-start lamp.

6. The glow plug actuation indicator of claim 1 wherein the lamp actuation circuitry further includes latching circuitry to inhibit the reactuation of the wait-to-start lamp prior to subsequent toggling of the ignition switch.

7. A power control system for controlling application of high electrical power to a glow plug in an internal combustion diesel engine to actuate the plug in a pre-glow mode of operation for a period of time subsequent to toggling an ignition switch to an on position, the engine having associated therewith a glow plug controller including circuitry for generating an output signal at an output node indicating that the glow plug is to be actuated in the pre-glow mode of operation, said power control system comprising:

a) a solenoid coupled to said glow plug, the solenoid actuating the glow plug in the pre-glow mode of operation when a high power signal is applied to the solenoid;

b) circuitry coupled to the glow plug controller output node and to the solenoid whereby a high power signal is applied to the solenoid when said glow plug controller output signal is present at the glow plug controller output node, said circuitry comprising:

i) a field effect transistor coupled to the glow plug controller output node and the solenoid, the field effect transistor adapted to be turned on when the output signal is present at the glow controller output node and be turned off otherwise; and ii) voltage regulation and transistor actuation circuitry including a pair of matched transistors coupled between the glow plug controller output node and said field effect transistor for providing a regulated source of voltage to a gate of the field effect transistor for gating said field effect transistor such that the transistor is turned on in response to the output signal at the glow plug controller output node.

8. The power control system of claim 7 wherein the field effect transistor is a P-channel enhancement-mode power field effect transistor.

* * * * *